United States Patent [19]

Park et al.

[11] 4,134,841

[45] Jan. 16, 1979

[54] FIBER LUBRICANTS

[75] Inventors: Kisoon Park, Charleston; Robert H. Lowery, Alum Creek, both of W. Va.

[73] Assignee: Union Carbide Corporation, New York, N.Y.

[21] Appl. No.: 885,297

[22] Filed: Mar. 10, 1978

[51] Int. Cl.[2] ..... D06M 13/18

[52] U.S. Cl. ..... 252/8.9; 252/48.6; 8/115.6; 428/375

[58] Field of Search ..... 252/8.9, 48.6; 8/115.6; 428/375

[56] References Cited

U.S. PATENT DOCUMENTS

| | | | |
|---|---|---|---|
| 3,387,996 | 6/1968 | Tolliver | 252/8.9 |
| 3,919,097 | 11/1975 | Park | 252/8.9 |
| 3,963,628 | 6/1976 | Park | 252/8.9 |
| 4,019,990 | 4/1977 | Marshall et al. | 252/8.9 |

*Primary Examiner*—William E. Schulz

*Attorney, Agent, or Firm*—Francis M. Fazio

[57] ABSTRACT

Fiber lubricant compositions of enhanced heat stability comprise a nonhindered polyphenol stabilizer and a polyether lubricant.

9 Claims, No Drawings

FIBER LUBRICANTS

BACKGROUND OF THE INVENTION

During the manufacture and processing of synthetic fibers, the fibers undergo various heat treatments, such as hot drawings to impart yarn strength, texturing to achieve desired aesthetic and mechanical properties, and heat setting to achieve bulk or dimensional stability. Since fiber lubricants are necessary during these procedures, it is important that the finish or lubricant be stable at the elevated temperatures employed. The lubricant should be thermally stable and not fume excessively; when exposed to the heated surfaces it should not produce a char or gum but rather a fluid residue if any decomposition does occur because gummy or varnish like residues tend to accumulate on the heated surface, create a drag on the yarn and result in yarn breakage or non-uniform stretching of the fibers. It is also important that any accumulated residue be removed readily, for example with soapy water, to facilitate cleaning of the equipment. These problems are particularly evident with the conventional polyoxyalkylene lubricants.

SUMMARY OF THE INVENTION

Fiber lubricant compositions of improved thermal stability have been produced containing polyoxyalkylene compounds as the lubricant and non-hindered phenols as the thermal stabilizers. These compositions have been found to have lower volatility or fuming and exhibited less tendency to char or form gummy, difficult to remove residues on heating when compared to many conventionally available lubricant compositions.

DESCRIPTION OF THE INVENTION

In the manufacture of synthetic textile fibers and fabrics it is necessary to lubricate the yarn to prevent breakage and to maximize production. Among the most used lubricants are the polyoxalkylene compounds. However, these compounds present problems in that they are subject to thermal degradation. Consequently, stabilizers have been added to them in attempts to overcome the problem, such as the hindered phenols, for example, 1,3,5-trimethyl-2,4,6-tris[3,5-di-tert-butyl-4-hydroxybenzyl]benzene, 4,4'-methylenebis (2,6-di-tert-butylphenol), 4-hydroxymethyl-2,6-di-tert-butylphenol, tetrakis[methylene 3-(3',5'-di-tert-butyl-4'-hydroxyphenyl)propionate]methane, or any of the other known stabilizers. Also the stabilizers have been used at concentrations below about 3 weight percent, usually less than one weight percent.

It has now been found that certain nonhindered polyphenols, when used at relatively high concentrations, afford unexpectedly improved thermal stability to the polyoxyalkylene lubricants. These non-hindered polyphenols have either 2 or 3 hydroxyphenyl groups in the molecule and are represented by the general formula:

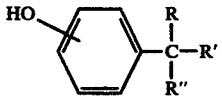

in which R is methyl or ethyl; R' is hydroxyphenyl or

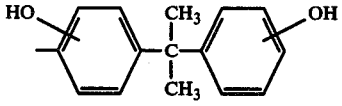

and R'' is methyl or hydroxyphenyl. The term "non-hindered polyphenol" signifies a compound that has no hindering alkyl or other groups ortho to the hydroxyl groups of the phenyl moiety of the molecule. Substituents may be located at other positions in the phenyl ring but they are not located adjacent to the hydroxyl group if they have a hindering effect.

Illustrative of useful non-hindered polyphenols one can mention 4,4'-isopropylidene diphenylol, 2,4-isopropylidene diphenylol, trisphenol, triphenylolpropane, and 2,2',2''-triphenylol ethane.

The concentration of the non-hindered polyphenol in the lubricant composition is from 5 to 20 weight percent thereof; preferably from 5 to 10 weight percent, based on the weight of non-hindered polyphenol plus the weight of polyoxyalkylene compound.

The polyoxyalkylene lubricants that are stabilized are the random, block or capped copolymeric or homopolymeric polyoxyalkylene glycols or their ether or ester derivatives. These can be represented by the simple generic formula $$XO(CH_2CH_2O)_x(\overset{\overset{\displaystyle CH_3}{|}}{C}HCH_2O)_yX$$

wherein X is hydrogen, $-C_mH_{2m+1}$ or $C_mH_{2m+1}CO-$; m is an integer having a value of from 1 to 22; and the sum of x plus y is such that the number average molecular weight of the compound is from about 800 to about 20,000. These compounds are well known to those skilled in the art, as described in U.S. Pat. Nos. 2,425,845 and 2,425,755, and many of them are commercially available. For industrial use, the most preferred polyoxyalkylene glycol lubricants for textile manufacturing processes are the copoly(oxyethylene-oxypropylene) compounds containing from 25 to 75 weight percent oxyethylene in the molecule.

The concentration of the polyoxyalkylene compound in the lubricant composition of this invention is from 80 to 95 weight percent thereof, preferably from 90 to 95 weight percent, based on the combined weight of the non-hindered polyphenol and the polyoxyalkylene compound.

The lubricant compositions of this invention can also contain any of the known and conventional coupling agents, antistatic agents, friction modifiers, viscosity index improvers, corrosion inhibitors, load carrying capacity improvers, buffering agents, or other additives normally used. The amount of the particular additive used is the concentration normally used. Both the additives and their conventional concentrations are known to those skilled in the art and require no further discussion here. The lubricant compositions are readily prepared by conventional and known mixing procedures.

In the experimental data obtained, it was found that some hindered phenols now used as lubricant stabilizers would provide adequate stability for short periods of exposure, less than 5 hours, at 200° C.; however, their effectiveness rapidly diminished beyond this period. Others suffered the defect of becoming highly discolored or gummy on prolonged heating. On the other hand, the compositions of this invention did not show these problems. In addition, lubricant compositions previously available fumed and volatilized at an appreciably higher rate than do the compositions of this invention.

In evaluating the lubricant compositions of this invention two procedures were used, in one the bulk fluid volatility or fuming tendency of the lubricant was determined and in the other the thin-film volatility or amount of gummy material and the ease with which it is removed from the surface are determined. In all instances the compositions of this invention showed overall superior results when compared to compositions using the conventional stabilizers at the heretofore used conventional quantities. The test procedures used to evaluate the lubricant compositions of this invention are described below:

Bulk Fluid Volatility

Ten grams of the test lubricant, contained in a glass dish with 3 square inch opening, are placed in a forced-air oven at 200° C. The weight loss of the lubricant in a 5 hour period is determined. The average weight loss per hour is then reported.

Thin-Film Volatility

One gram of the test lubricant is placed in an aluminum dish (2-inch diameter) and heated for 24 hours on a hot plate set at 220° C. The amount of residue, expressed as percent by weight of the original sample, the appearance and the removability are determined. The removability is determined by soaking the residue in soapy water containing a detergent such as Tide ®, for a few minutes, followed by brushing with a soft paint brush.

The following examples serve to illustrate the invention. Parts are by weight unless otherwise indicated.

EXAMPLE 1

A clear, water soluble, textile lubricant composition was produced by mixing at 25° C. 60 parts of copoly(oxyethylene-oxypropylene) butyl monoether having an average molecular weight of 860 and an oxyethylene content of 50 weight percent, 30 parts of the 9 mole ethoxylate adduct of a mixture of $C_{11}$ to $C_{15}$ secondary alkanols, and 10 parts of 4,4'-isopropylidene diphenylol. This textile lubricant composition had a Bulk Fluid Volatility of only 4.2 percent per hour. The thin film was an amber fluid; it was readily removed with the detergent solution.

EXAMPLE 2

A lubricant composition was produced containing 95 parts of copoly (oxyethylene-oxypropylene) butyl monoether having an average molecular weight of 860 and an oxyethylene content of 50 weight percent lubricant and 5 parts of 2,2-diphenylolpropane. The composition had a Bulk Fluid Volatility of 7 percent per hour. At the completion of the Thin-Film Volatility test the residue was a yellow liquid representing 5.3 percent of the original weight and it was readily removed by soapy water.

For comparative purposes three other compositions were evaluated, the first was the same lubricant without any added stabilizer, the second contained 99.5 parts of the same lubricant and only 0.5 parts of 2,2-diphenylolpropane, and the third contained 99.5 parts of the same lubricant and 0.5 part of 1,3,5-trimethyl-2,4,6-tris[3,5-di-tert-butyl-4-hydroxybenzil] benzene. The test results of these controls showed that they were inferior to the composition of this invention. All formed dark brown solid residues that could not be removed with the soapy water. It is to be noted that the stabilizer used in the third control is immiscible at concentrations above about 2 percent.

EXAMPLE 3

Two lubricant compositions were produced by adding 5 and 10 weight percent of 2,2-diphenylolpropane to tetraethylene glycol di-2-ethylhexanoate (M.W.446), in accord with this invention (Runs 1 and 2). These were compared with seven control compositions free of stabilizer, or an amount of stabilizer outside the scope of this invention or another conventional stabilizer (Runs 3–9). None of the controls possessed the desirable overall properties shown by our compositions. The results are shown in Table I.

TABLE I

| Run | Stabilizer | Conc. % | Bulk Fluid Volatility, % loss | Thin-Film Volatility % Orig. Wt. | Appearance | Removability |
|---|---|---|---|---|---|---|
| 1 | DPP | 5 | — | 23 | Amber Liquid | Yes |
| 2 | DPP | 10 | 6.6 | 36 | Amber Liquid | Yes |
| Controls | | | | | | |
| 3 | None | — | 19.4 | <1 | Dark Brown Solid | No |
| 4 | DPP | 0.5 | 12.5 | 1 | Dark Brown Solid | No |
| 5 | 1035 | 0.5 | 7 | <1 | Dark Brown Solid | No |
| 6 | 1035 | 2 | 9.3 | — | Dark Brown Solid | No |
| 7 | 1076 | 2 | 8.7 | — | Dark Brown Solid | No |
| 8 | PT | 8 | 4.6 | <1 | Dark Brown Solid | No |
| 9 | Naugard | 10 | 6.2 | — | Brown Liquid Solid Specks | Yes |

1076 = beta - (3,5-di-tert-butyl-4-hydroxyphenyl) propionate
Naugard = 4 4'-[2-(2-phenyl)propyl]diphenylamine
DPP = 2,2-Diphenylolpropane
PT = Phenothiazine 1035 = 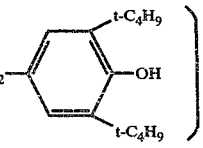

EXAMPLE 4

A series of textile lubricants was prepared in accord with this invention and compared to a series of controls. In all instances the compositions of this invention showed better stability, less color development and solid formation, and ready removal with soapy water. The results are shown in Table II. The lubricant used in this example was copoly (oxyethylene-oxypropylene) butyl monoether having an average molecular weight of 860 and containing 50 weight percent oxyethylene groups.

TABLE II

| Run | Stabilizer | Conc. % | Bulk Fluid Volatility, % Loss | Thin-Film Volatility % Orig. Wt. | Appearance | Removability |
|---|---|---|---|---|---|---|
| 1 | DPP | 7 | — | 53 | Yellow Liquid | Yes |
| 2 | DPP | 10 | 5 | Ca. 55 | Yellow Liquid | Yes |
| 3 | DPP | 15 | 5 | 41 | Yellow Liquid | Yes |
| 4 | TPP | 10 | — | 91.6 | Yellow Liquid | Yes |
| Controls | | | | | | |
| 5 | None | — | Ca. 16.5 | <1 | Dark Brown Solid | No |
| 6 | DPP | 1 | — | <1 | Dark Brown Solid | No |
| 7 | 1035 | 5 | — | 1.5 | Brown Solid | No |
| 8 | 1076 | 5 | — | 2.6 | Brown Solid | No |
| 9 | 565 | 10 | 4.3 | — | Dark Brown Solid | No |
| 10 | Aminox | 1 | 6.1 | — | Dark Brown Liquid | Yes |
| 11 | Naugard | 3.8 | 2.6 | — | Brown Solid | No |
| 12 | 712 | 5 | 33.3* | 0.7 | Dark Brown Varnish | No |

DPP = 2,2-Diphenylolpropane
TPP = 1,1,3-Triphenylolpropane
1035 = See Table I
1076 = See Table II
Naugard = See Table I
565 = 2,4-bis(n-octylthio)-6-(4-hydroxy-3,5-di-tert-butylanilino)-1,3,5-triazine
Aminox = Reaction product of diphenlamine and acetone
712 = 4,4' bis(2,6-di-tert-butyl phenol)
* = Average weight loss per hour of one gram sample heated for 3 hours at 200° C.

EXAMPLE 5

Another stabilized textile lubricant was prepared according to this invention and was compared to two control lubricants containing un-hindered, or partially hindered thiophenol compounds as stabilizers. The results are shown in Table III. The test lubricant was the same as the one described in Example 4. The stabilizer of this invention exhibited an advantage of affording less discoloration in the heated residue than the sulfur containing compounds.

TABLE III

| Run | Stabilizer | Conc. % | Thin-Film Volatility % Orig. Wt. | Appearance | Removability |
|---|---|---|---|---|---|
| 1 | DPP | 5 | 22.4 | Amber Liq. | Yes |
| 2 | TDP | 5 | 42.7 | Dark Brown Liq. | Yes |
| 3 | MRS | 5 | 17.4 | Dark Brown Gel. | No |

DPP: 2,2'-diphenylolpropane
TDP: 4,4'-Thiodiphenol
MRS:

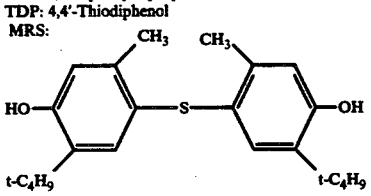

What is claimed is:

1. A stabilized fiber lubricant composition comprising:

(A) from 5 to 20 weight percent of a non-hindered polyphenol of the formula:

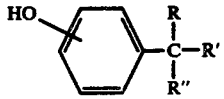

having 2 or 3 hydroxyphenyl groups wherein R is methyl or ethyl; R' is hydroxyphenyl or

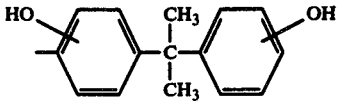

R'' is methyl or hydroxyphenyl; and (B) from 80 to 95 weight percent of a polyoxyalkylene lubricant of the formula:

$$XO(CH_2CH_2O)_x(\overset{CH_3}{\overset{|}{C}}HCH_2O)_yX$$

wherein X is selected from the group of hydrogen, $-C_mH_{2m+1}$ or $C_mH_{2m+1}CO-$; m is an integer having a value of from 1 to 22; and the sum of x plus y is such that the average molecular weight of said polyether lubricant is from about 800 to about 20,000 or the ether or ester derivative thereof; and wherein said percentages are based on the combined weights of (A) and (B).

2. A composition as claimed in claim 1, wherein component (A) is present at a concentration of from 7 to 12 weight percent.

3. A composition as claimed in claim 1, wherein component (A) is 2,2-diphenylolpropane.

4. A composition as claimed in claim 1, wherein component (A) is 1,1,3-triphenylolpropane.

5. A composition as claimed in claim 1, wherein component (B) is tetraethylene glycol di-2-ethylhexanoate having an average molecular weight of 446.

6. A composition as claimed in claim 1, wherein component (B) is copoly (oxyethylene-oxypropylene) butyl monoether having an average molecular weight of 860 and an oxyethylene content of 50 weight percent.

7. A composition as claimed in claim 3, wherein component (B) is tetraethylene glycol di-2-ethylhexanoate having an average molecular weight of 446.

8. A composition as claimed in claim 3, wherein component (B) is copoly (oxyethylene-oxypropylene) butyl monoether having an average molecular weight of 860 and an oxyethylene content of 50 weight percent.

9. A composition as claimed in claim 4, wherein component (B) is copoly (oxyethylene-oxypropylene) butyl monether having an average molecular weight of 860 and an oxyethylene content of 50 percent.

* * * * *